US007309375B2

(12) United States Patent
Tornberg

(10) Patent No.: US 7,309,375 B2
(45) Date of Patent: Dec. 18, 2007

(54) METHOD FOR PRODUCING METALLIC POWDERS CONSISTING OF IRREGULAR PARTICLES

(76) Inventor: Claes Tornberg, Eskadervägen 8, SE-183 54, Täby (SE)

( * ) Notice: Subject to any disclaimer, the term of this patent is extended or adjusted under 35 U.S.C. 154(b) by 482 days.

(21) Appl. No.: 10/491,795

(22) PCT Filed: Sep. 30, 2002

(86) PCT No.: PCT/AT02/00284

§ 371 (c)(1),
(2), (4) Date: Jul. 27, 2004

(87) PCT Pub. No.: WO03/031103

PCT Pub. Date: Apr. 17, 2003

(65) Prior Publication Data

US 2004/0245318 A1 Dec. 9, 2004

(30) Foreign Application Priority Data

Oct. 10, 2001 (AT) ..... A 1594/2001
Apr. 3, 2002 (AT) ..... A 515/2002

(51) Int. Cl.
*B22F 9/06* (2006.01)

(52) U.S. Cl. ..... 75/338

(58) Field of Classification Search ..... 75/338
See application file for complete search history.

(56) References Cited

U.S. PATENT DOCUMENTS 4,298,553 A 11/1981 Ayers (Continued)

FOREIGN PATENT DOCUMENTS

EP 0 377 106 7/1990

(Continued)

*Primary Examiner*—George Wyszomierski
(74) *Attorney, Agent, or Firm*—Buchanan Ingersoll & Rooney PC

(57) ABSTRACT

The invention relates to the production of a metallic powder consisting of surface-fissured, so-called irregular particles, namely a water-atomised metallic powder. The aim of the invention is to obtain an irregular surface form of powder grains (23) in a narrow weight class and to impart a high porosity with a homogeneous distribution to the sintered body. To this end, in a first step, the pouring stream (2) is deviated in its flow direction and is enlarged on its surface, and in a second step, the surface-enlarged pouring stream (21) is deviated again its flow direction and is divided, and the liquid metallic particles (22) formed are accelerated, and in a third step, the displaced liquid metallic particles (22) are applied and divided, at an angle γ of between 10 and 90° in relation to the displacement direction of the same, with a high speed current (51) formed at least partially from a liquid medium, and the particles (23) are then solidified. According to one embodiment of the invention, in order to reduce the overheating of the metal melt and/or to improve the quality of the metallic powder produced, the pouring stream (2) is deviated in its flow direction and a surface enlargement of the same (21) is carried out, in a first method step, and/or the surface-enlarged pouring stream (21) is deviated and divided, and the formed liquid metallic particles (22) are accelerated, in the second method step, with at least one current (6,31,41) formed from at least one heated gas or heated gas mixture.

22 Claims, 2 Drawing Sheets

U.S. PATENT DOCUMENTS

Figure 1:
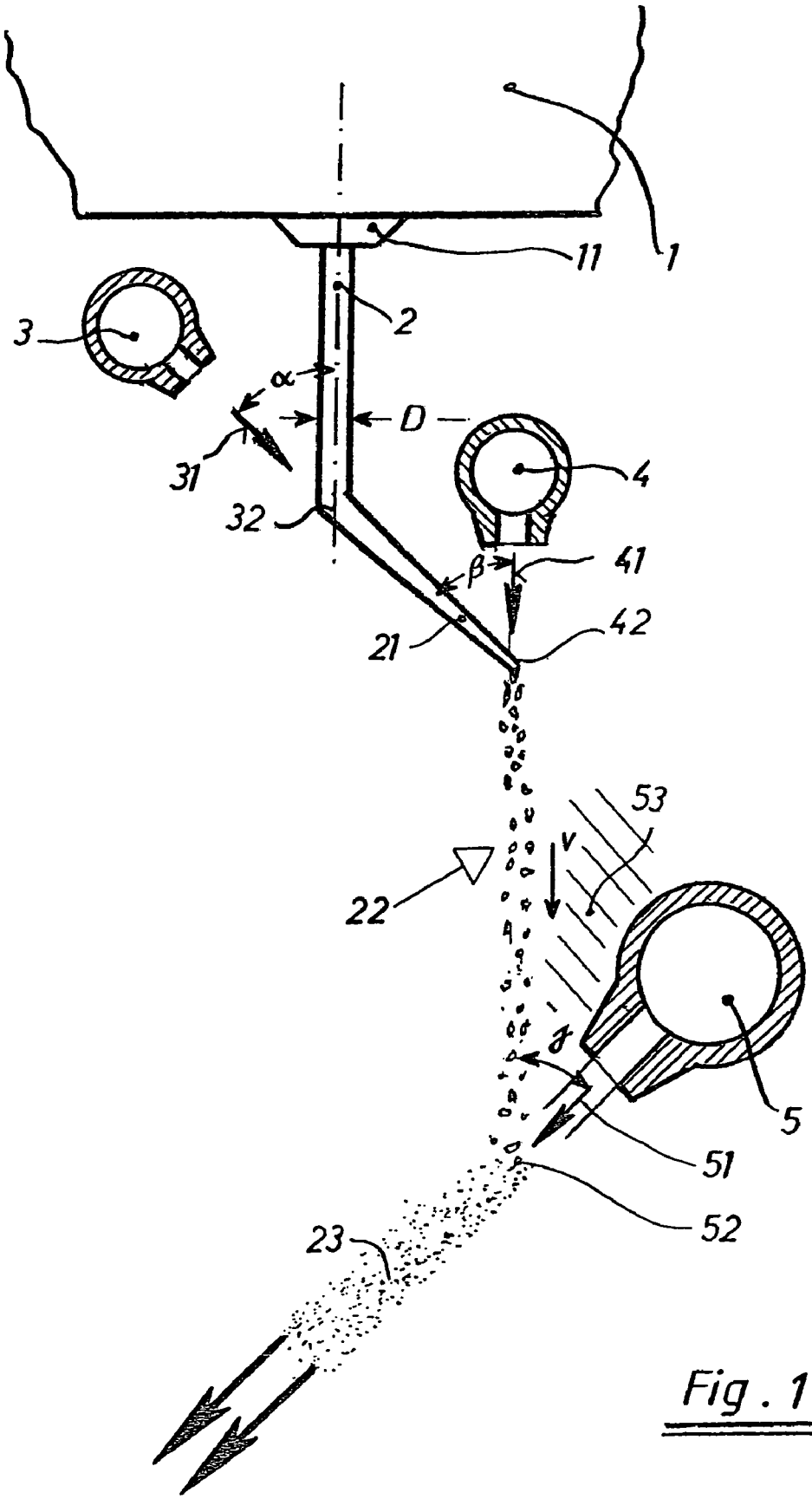

| | | | | |
|---|---|---|---|---|
| 4,604,306 | A | 8/1986 | Browning | |
| 5,242,110 | A * | 9/1993 | Riley | 239/11 |
| 6,334,884 | B1 * | 1/2002 | Tornberg | 75/337 |

FOREIGN PATENT DOCUMENTS

| | | |
|---|---|---|
| EP | 1 022 078 | 7/2000 |
| FR | 877 043 | 11/1942 |

* cited by examiner

METHOD FOR PRODUCING METALLIC POWDERS CONSISTING OF IRREGULAR PARTICLES

The invention relates to a method for producing a metallic powder consisting of surface-fissured, so-called irregular particles by charging a pouring stream of a metal melt with a liquid medium.

Metallic powders are mostly produced by dividing a liquid melt into particles and then solidifying these particles. As the means for a disintegration of the liquid metal into small droplets, according to the state of the art, essentially, gas or liquid streams are known, which are allowed to affect a melt current with a high level of kinetic energy.

If the melt current is charged with gas, because of the surface tension of the liquid metal largely round droplets are then formed which solidify during their movement in the system and which are provided in this system in a container. This so-called gas-atomised metallic powder with largely round particles exhibiting an essentially smooth surface is ideal for producing dense bodies or materials, for example by hot isostatic pressing.

A surface-fissured, so-called irregular powder grain is created by a division of the metal current with liquids, especially with water. The so-called water-atomised metallic powder generally has after drying a lower bulk weight, which means that the flow properties are also poorer because of the shape of the surface. By placing the powder into a mould and pressing it afterwards, a so-called green compact is formed, which is consistently porous because of the fissured surface structure of the grains. The green compact or briquette before sintering often has a desired stability that encourages non-destructive manipulation thereof. The irregular powder grain shape is advantageously suited for producing, by sintering from water-atomised powders of this type, objects which show a high cohesive inner porosity, which may however be non-homogeneously distributed.

A particular area of application for objects or machine parts with a high inner porosity are maintenance-free sliding bearings in which the cavities showing connections are filled with lubricant.

To be able to ensure the quality and required usage characteristics of the produced parts, there must generally be a homogeneous cavity formation with good pressing qualities of the powder and a good sintering behaviour of the green compact. In other words: the powder grains should have an irregular surface structure with as many irregular, if necessary sharp-edged projections as possible and essentially an even, low grain weight.

In principle, division of a molten metal with liquid or a so-called water atomisation of metal to powder takes place by charging an essentially vertical metallic pouring stream sideways with water directed downwards (Metal Powder Production and Characterization, ASM Handbook, Volume 7, Powder Metal Technologies and Applications, pages 35 to 52). The high-pressure or high-speed water jet can have a ring-shaped V shape or wedge shape, an open V shape, a closed V shape, a pyramid shape or a special shape. What is important for the formation of the powder particles is the angle at which the water jet hits the metal stream or the horizontal speed component on the metal stream. As the acute angle of the water jet increases, the average particle size of the powder falls. However, because of the process, there is a limit on any enlargement of the angle of impact of the water jet and thus any reduction in powder grain size because, when a particular flow angle is exceeded, instable division conditions are created for the liquid metal, which is then carried partly on the water jet, and/or a so-called "welled-up water" phenomenon occurs.

A further problem is the grain size distribution of water-atomised powders because the portion of small particles suitable, if necessary, for injection moulding is low and requires time-consuming classification.

In order to achieve a high yield of usable powder with good compacting characteristics and a low oxygen content in it, it has already been proposed (U.S. Pat. No. 4,191,516) to charge the pouring stream in an enclosed vessel in the axial direction with two open V shaped water jet pairs which are at an angle of approx. 90° from each other. The first water jet pair has a larger acute angle to the axis of the pouring stream, hits it earlier and forms it into a strip. The following pair of water jets brings about a division of the pouring stream strip into droplets. This type of system can admittedly achieve a certain improvement in the quality of the powder, but the size of the powder grains is not uniform, the portion of small, scattered, irregular powder grains is low and generally the sintering properties are not good enough.

The object of the invention is to overcome the given disadvantages of the state of the art and to provide a method of the type mentioned at the beginning with which metallic powder with low grain weights lying within narrow limits or a high portion of small powder grains and an improved sharp-edged or irregular surface shape can be produced, and that this powder should have better processing properties and a higher quality of the parts sintered from it.

This object is achieved according to the invention in the case of a generic method by the fact that in an initial step the pouring stream is deviated in its flow direction and enlarged on its surface, following which in a second step the surface-enlarged pouring stream is again deviated in its flow direction with a division of the same and the liquid metal particles formed are accelerated and in a third step the displaced liquid metal particles are charged at an angle of $\gamma$=10 to 90° in relation to the displacement direction of the same with a high speed current formed at least partially with a liquid medium, divided and allowed to solidify.

The advantages achieved by the invention are mainly to be seen in the fact that the incorporation of specific disintegration energy into the liquid metal can be decisively enlarged which then improves the particle size, the surface formation and the irregularity and homogeneity of the grain weight of the powder. It was found that with a deviation of the pouring stream from a flow direction by charging on one side an enlargement of the surface and a thinning of the same can be achieved particularly favourably. The flow direction of the metal current which is still essentially cohesive is then once again changed by being charged on one side, preferably from a side opposite to the first deviation. Advantageously, because of the enlarged surface of the thinned metal current, this is then divided into liquid metal particles, which are also accelerated by the flow of the charging agent. In this way, the liquid metal particles have a high kinetic energy when they meet together with the high speed current formed at least partially by liquid medium and are practically shot into this, which also suppresses the "welled-up water" phenomenon. In other words: by an interplay, in the sequence, between the influencing of the pouring stream or metal current in the first two steps by a deviation and enlargement of the cross-section of the pouring stream and, after this, by a flow direction deviation, division and acceleration of the formed liquid metal particles, in the following step, a large angle of charging of the liquid high speed current can be applied without leading to the so-called "welled-up water" phenomenon. These circumstances create, on the one hand, an effective disintegration of the liquid metal particles into small particles, largely of equal weight, and on the other hand an advantageous surface shape of the powder grains solidified from the particles.

The method can be carried out particularly effectively, especially with a considerable overheating of the metal from the pouring stream, if there is a deviation of the pouring stream and a surface enlargement of the same in the first step of the method and/or a deviation of the surface-enlarged pouring stream and its division and an acceleration of the formed liquid metal particles in the second step of the method with (a current) currents formed at least partly with liquid medium.

If, according to one embodiment of the invention, a deviation of the flow direction and a surface enlargement of the pouring stream occur in the first step of the method with a gas current, a comparatively lower loss of thermal energy from the liquid metal is achieved or a loss of overheating is reduced, which means that a division into liquid metal particles with a low viscosity can be promoted.

According to a further embodiment of the invention, it is advantageous if a deviation of the surface-enlarged pouring stream and its division and an acceleration of the liquid metal particles formed occur in the second step of the method with a gas current. This measure produces a lower reduction in temperature in the area of the metal particles near the surface in particular when these are accelerated, and intensifies the fissuring or becoming irregular of the surface of the powder grains during impacting and/or immersion into the high speed current formed with liquid medium in the third step of the method. It is assumed that this favourable effect is achieved by an improved surface contact between the metal with a high degree of liquidity, or with increased overheating, and the liquid medium.

Although, in methods according to the state of the art, considerable overheating of the metal often has a favourable effect on the powder grain shape, which can, however, bring disadvantages in terms of the kinetics of the reaction or commercial disadvantages, it is advantageous with the method according to the invention if the metal stream is given such an overheating and, for the disintegration of the same, such an overheating is maintained so that in the third step of the method while charging with a high speed current, with at least a partially liquid medium, of the liquid metal particles formed in the second step of the method, a surface temperature, that is higher than the solidus temperature of the alloy without a uniform temperature distribution throughout the cross section is achieved in the metallic particles. It could be concluded that this advantage is connected with the incorporation of increased specific disintegration energy into the liquid metal, whereby specific disintegration energy is to be understood as the effective energy for a division and charging of the metal per weight unit of the same.

What is completely surprising for the specialist familiar with the "welded-up water" phenomenon was the fact that if the method according to the invention is used, the acute flow angle of the metal current can be considerably enlarged. Particularly good powder quality is achieved if the accelerated liquid metal particle current is charged at an angle of more than 45° by the high speed current.

To obtain powder grains that are of the same weight as far as possible, it may be advantageous if the liquid metal particle current is charged and divided by a high speed flat current with an at least partly liquid medium.

In a further development of the method according to the invention, it has been found advantageous with regard to a high yield of powder with small grains in irregular shape if the division and acceleration of the liquid metal particles in the second step of the method are carried out along a route of at least the diameter of the pouring stream times 10 and that a charging by the high speed current and the division from a short distance should be carried out with a nozzle distance of less than the diameter of the pouring stream times 8.

The invention further relates to an embodiment of the method mentioned at the beginning through which the quality of the irregular powder from some metals and alloys is improved.

This object is achieved by the fact that a deviation of the pouring stream in its flow direction and a surface enlargement of the same in the first step of the method and/or a deviation of the surface-enlarged pouring stream and its division, and an acceleration of the formed liquid metal particles in the second step of the method should occur with (a current) currents formed from heated (gas) gases.

An advantage of the method achieved in this way is essentially that a lower overheating of the melt is required, which produces improved durability of the refractory lining of the supply container and the nozzle device. Surprisingly, it was found that the diameter of the irregular powder grains was smaller and more even when the method according to the invention was applied. This is obviously due to a better utilisation of the disintegration energy when the liquid metal particles are charged by means of the high speed current. In addition, with a pouring stream treatment of this type, the degree of the viscosity in the surface area of the liquid metal particles seems to be retained until the latter have been charged with the high speed current, since preferably only a narrow, small range of size of the powder grains with improved irregularity is reached according to the method.

According to the invention, it is proposed that the gas current for the first and/or for the second step of the method should be heated to a temperature above room temperature, preferably over 200° C., especially over 400° C., if necessary using a heat exchanger. However, it is also possible with regard to the precise setting of the increased temperature of the gas current to provide additionally or solely an electrical heating of the same. This can be done, for example, with a coiled heating filament in a flow channel. In this way, it is possible to reduce or delay the surface heat loss and increasing viscousness of the area near the surface of smaller metal particles in particular.

In addition, it is also preferable if, for the first and/or the second step in the method, a gas or gas mixture with a low cooling effect on the surface of the pouring stream or liquid metal particles is used.

With a method of the type mentioned at the beginning, it may also happen that a deviation of the pouring stream in its flow direction and a surface enlargement of the same in the first step of the method and/or a deviation of the surface-enlarged pouring stream and its division, and an acceleration of the formed liquid metal particles in the second step of the method occur at least partly with waste gas current(s) formed during combustion.

The advantages of this are essentially due to the fact that the gas current(s) for the pre-treatment or preparation of the pouring stream for a fine division of the latter by means of the high speed current is/are produced particularly simply and cheaply. The combustion of a gas mixture can produce, on the one hand, a heating of the treatment gas current and, on the other, due to a resultant increase in volume, a favourable increase in intensity of the current. In addition, the combustion can also reduce the oxygen content in the treatment current.

It is particularly advantageous if, for the first and/or for the second step of the method, the gas current is heated and formed in a system containing a burner, especially a high speed burner. In this way, precisely focussed, the pouring stream emerging from the distributor and/or the surface-enlarged pouring stream can, in the second step of the method, be charged with hot gas and prepared in such a way that the preconditions for division of the same in the third step of the method into high-quality metal powder as required can be achieved.

The invention is explained in the following using a drawing showing one embodiment only.

As can be seen from the schematic representation in the drawing, FIG. 1, a metallurgical container 1 contains an overheated melt which emerges through a nozzle stone 11 forming a pouring jet 2 with a diameter D from this in a vertical direction.

A device 3, which is formed advantageously as a flat stream nozzle device, charges in a first step of the method the vertical pouring stream 2 at an acute angle $\alpha$ with a deviation medium 31, e.g. water, water-gas mixture or gas, whereby the pouring stream 2 is impacted in the area 32 in such a way that this is broadened in a way that enlarges the surface.

The broadened pouring stream 21 which is formed or runs largely or in large areas still cohesively is impacted subsequently by a charging system 4 with a medium stream 41 advantageously formed with a broad shape, at an acute angle $\beta$. When the broadened pouring stream 21 and the medium stream 41 meet together according to the second step of the method in area 42, there is another deviation of the broadened pouring stream 21 and a division of the same into liquid metal particles 22. In addition, by means of the medium stream 41, the liquid metal particles 22, as shown by the symbol V, are accelerated. The accelerated liquid metal particles 22 are then brought or enclosed, in area 52, into a flat high speed current 51, which is directed at an angle $\gamma$ to the trajectory of the metal particles 22. A high kinetic energy of the liquid metal particles 22 on the one hand and the high speed current 51 formed at least partly by liquid medium on the other hand produce high levels of specific disintegration energy of the metal and thus, at a high performance, largely equally small particles with a high level of irregularity of the individual powder grains. The area 53 of the charging system 5 has, as a result of the media stream 41, an increased pressure and prevents the depositing of liquid metal droplets on the system components 5.

Tests have shown that the media streams 31 and 41 of the first and second steps in the method can completely advantageously be formed by gas, preferably nitrogen, whereby a gas charging in the preparation of the metal current for the powder grain division can produce a lower surface loss of overheating warmth from the metal particles and an increased irregularity of the grain surface of the powder with increased economy.

Figure 1A:
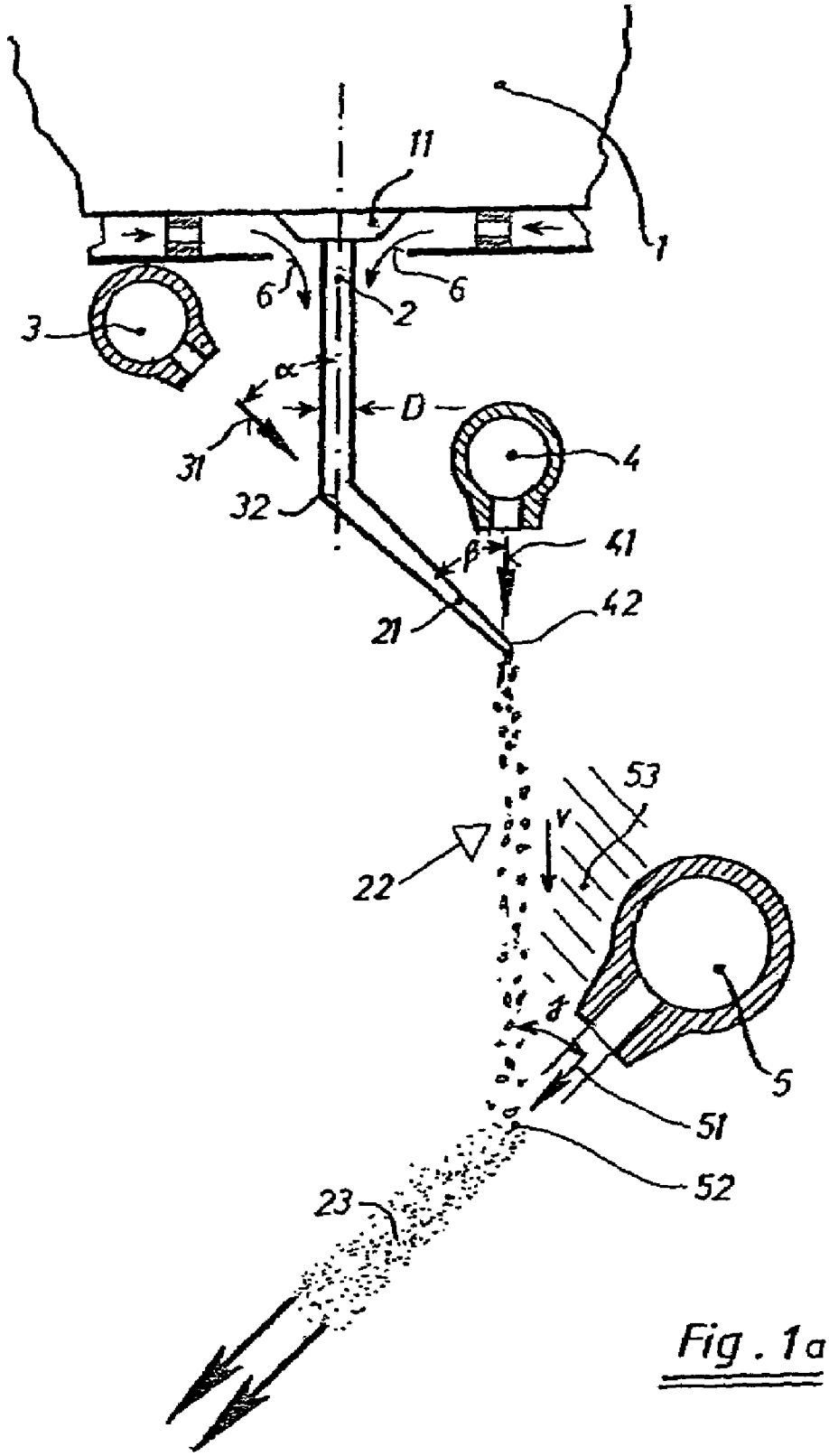

The design of the invention is explained on the basis of a schematic representation in FIG. 1*a*.

A metal pouring stream 2, which is if necessary only slightly overheated, emerges from a metallurgical container through a nozzle stone 11. The pouring stream 2 may be accompanied by an enclosing gas current 6 which is brought to a temperature above room temperature.

A system formed preferably as a flat stream system 3 for charging and deviating the pouring stream 2 creates a warm gas current 31, for example with a temperature of over 600° C., which enlarges the surface of the pouring stream 2 without having an increased cooling effect.

A further charging system 4 can also produce a warm or hot gas current 41 which if necessary, also without disadvantageous cooling, divides the surface-enlarged pouring stream 21 and accelerates the liquid metal particles. The charging systems 3 and 4 can also be formed at least partly as a burner system.

Finally, it can also be proposed, according to the invention, that the liquid medium is converted in the high speed current by a temperature increase into the form of steam and that the liquid metal particles are charged by this in the third step of the method. It can be advantageous here both that the disintegration energy causes the powder particles to have small diameters and that the cooling intensity of the powder particles is increased, which means that a particularly high metal powder quality can be achieved.

The invention claimed is:

1. Method for producing a metallic powder consisting of surface-fissured, irregular particles by charging a pouring stream of a metal melt and impacting the pouring stream with a liquid medium, wherein in a first step the pouring stream is deviated in its flow direction and its surface is enlarged, following which in a second step another deviation of the flow direction of the surface-enlarged pouring stream occurs forming a current of liquid metal particles with a division of the same and an acceleration of formed liquid metal particles along a route and in a third step the liquid metal particles which are displaced are charged and divided at an angle $\gamma$ of 10 to 90° relative to the displacement direction of the same by a high speed current formed at least partly by said liquid medium, and the particles are allowed to solidify.

2. Method according to claim 1, wherein a deviation of the pouring stream in its flow direction and a surface enlargement of the same occur in the first step of the method and/or a deviation of the surface-enlarged pouring stream and its division and an acceleration of the formed liquid metal particles occur in the second step of the method with a current formed at least partly by the liquid medium.

3. Method according to claim 2, wherein a deviation from the flow direction and a surface enlargement of the pouring stream occur in the first step of the method with a gas current.

4. Method according to claim 2, wherein a deviation of the surface-enlarged pouring stream and its division and an acceleration of the liquid metal particles thus formed occur in the second step of the method with a gas current.

5. Method according to claim 1, wherein a deviation from the flow direction and a surface enlargement of the pouring stream occur in the first step of the method with a gas current.

6. Method according to claim 5, wherein the gas current is present for the first step of the method and is heated to a temperature above room temperature.

7. Method according to claim 5, wherein the gas current for the first and/or for the second step of the method is heated to a temperature over 200° C.

8. Method according to claim 5, wherein the gas current for the first and/or for the second step of the method is heated to a temperature over 400° C.

9. Method according to claim 1, wherein a deviation of the surface-enlarged pouring stream and its division and an acceleration of the liquid metal particles thus formed occur in the second step of the method with a gas current.

10. Method according to claim 9 wherein the gas current is present for the second step of the method and is heated to a temperature above room temperature.

11. Method according to claim 9 wherein the gas current for the second step is heated to a temperature over 200° C.

12. Method according to claim 9 wherein the gas current for the second step is heated to a temperature over 400° C.

13. Method according to claim 1, wherein the metal melt of the pouring stream is given such an overheating and for the division of the same such an overheating is maintained that when the liquid metal particles formed in the second step of the method are charged with a high speed current with an at least partly liquid medium in the third step of the method, a surface temperature exists higher than the solidus temperature of the alloy in the metal particles without temperature having been equalized across the cross-section.

14. Method according to claim 1, wherein the liquid metal particle current which is accelerated is charged at an angle $\gamma$ of more than 45° by the high speed current and divided.

15. Method according to claim 1, wherein the division into and acceleration of the liquid metal particles in the second step of the method occurs along a route of at least 10× the diameter of the pouring stream and that a charging by the high speed current and the division from a short distance are carried out with a nozzle distance of less than 8× the diameter of the pouring stream.

16. Method according to claim 1, wherein at least one medium charging the pouring stream is formed in a flat stream nozzle or in a multiple nozzle with openings along one level.

17. Method according to claim 1, wherein at least one medium charging the pouring stream is formed in a multiple nozzle with openings at least partly in more than one level over each other.

18. Method according to claim 1, wherein for the first and/or for the second step of the method a gas or gas mixture with a low cooling effect on the surface of the pouring stream or the liquid metal particles is used.

19. Method according to claim 1, wherein a deviation of the pouring stream in its flow direction and a surface enlargement of the same in the first step of the method and/or a deviation of the surface-enlarged pouring stream and its division and an acceleration of the formed liquid metal particles in the second step of the method occur at least partly with (a) waste gas current(s) formed during a combustion.

20. Method according to claim 19, wherein for the first and/or for the second step of the method the waste gas current is heated and formed in each case in a system containing a burner.

21. Method according to claim 1, wherein a gas stream encloses the pouring stream after its emergence from a nozzle stone of a distributor and is preheated.

22. Method according to claim 1, wherein the liquid medium in the high speed current is converted by a temperature increase into steam and that this then charges the liquid metal particles in the third step of the method.

* * * * *